US008100817B2

(12) United States Patent
Reichert et al.

(10) Patent No.: US 8,100,817 B2
(45) Date of Patent: Jan. 24, 2012

(54) PRESS ROLLER

(75) Inventors: Hermann Reichert, Heidenheim (DE); Uwe Matuschczyk, Geislingen (DE)

(73) Assignee: Voith Patent GmbH, Heidenheim (DE)

( * ) Notice: Subject to any disclaimer, the term of this patent is extended or adjusted under 35 U.S.C. 154(b) by 591 days.

(21) Appl. No.: 11/558,733

(22) Filed: Nov. 10, 2006

(65) Prior Publication Data

US 2007/0066469 A1 Mar. 22, 2007

Related U.S. Application Data

(63) Continuation of application No. PCT/EP2005/051202, filed on Mar. 16, 2005.

(30) Foreign Application Priority Data

May 13, 2004 (DE) ..... 10 2004 023 565

(51) Int. Cl.
*F16C 13/00* (2006.01)

(52) U.S. Cl. ..... 492/56; 492/20; 492/50

(58) Field of Classification Search ..... 492/56, 492/50, 20

See application file for complete search history.

(56) References Cited

U.S. PATENT DOCUMENTS

| | | | | |
|---|---|---|---|---|
| 649,145 | A * | 5/1900 | Thrush et al. | 492/23 |
| 2,678,474 | A * | 5/1954 | Butler | 492/45 |
| 2,775,793 | A * | 1/1957 | Cotchett | 19/295 |
| 3,812,561 | A * | 5/1974 | Lundgren | 492/33 |
| 5,634,606 | A * | 6/1997 | Roder | 242/555.3 |
| 5,649,267 | A * | 7/1997 | Aerens et al. | 399/159 |
| 5,932,069 | A | 8/1999 | Kuosa et al. | 162/199 |
| 6,940,045 | B2 * | 9/2005 | Sanpei et al. | 219/216 |

FOREIGN PATENT DOCUMENTS

| | | |
|---|---|---|
| DE | 4128655 | 3/1993 |
| EP | 0959257 | 11/1999 |
| EP | 1270808 | 1/2003 |
| EP | 1285990 | 2/2003 |
| JP | 1260092 | 10/1989 |
| JP | 6235183 | 8/1994 |
| JP | 9111687 | 4/1997 |
| WO | WO 02/090787 | 11/2002 |

OTHER PUBLICATIONS

Japanese Office Action dated Jun. 29, 2010 for Japanese Patent Application Serial No. 2007-512140.

* cited by examiner

*Primary Examiner* — Sarang Afzali

(74) *Attorney, Agent, or Firm* — Taylor IP, P.C.

(57) ABSTRACT

The invention provides a press roller, having a roller jacket made of plastic material, for treating a web of paper, board, tissue or another fibrous material in a machine for the manufacturing and/or finishing thereof. The aim of the invention is to enlarge the application fields of the press roller. Said aim is achieved, whereby the outer surface of the roller jacket is at least partially provided with a temperature-resistant protective layer and/or covering.

7 Claims, 3 Drawing Sheets

PRESS ROLLER

CROSS REFERENCE TO RELATED APPLICATIONS

This is a continuation of PCT application No. PCT/EP2005/051202, entitled "PRESS ROLLER", filed Mar. 16, 2005.

BACKGROUND OF THE INVENTION

1. Field of the Invention

The invention relates to a press roller with a roller jacket made of plastic material for the treatment of a paper-, board-, tissue- or other fibrous material web in a machine for the production and/or finishing thereof.

2. Description of the Related Art

Such press rollers are often used in de-watering units of these machines and in that context together with a counter roller form a pressure nip for the de-watering of the fibrous web. Applications are also known in the field of smoothing equipment. In both cases, the operating temperature in the pressure nip should be a maximum of approx. 80° C. because of the presence of the plastic jacket.

The object of the invention is to widen the areas of application of the press roller.

SUMMARY OF THE INVENTION

According to the invention, the object is achieved by arranging that in at least some areas the outer cylindrical surface of the roller jacket is provided with a temperature-stable protective layer and/or a cover.

Depending upon the nature of the roller jacket or the conditions to which it is exposed, certain areas of the roller jacket can be provided with a protective layer and other areas with a cover. However, to increase the temperature resistance it can also be advantageous to apply a temperature-stable protective layer to at least one area of the outer cylindrical surface followed by a temperature-stable cover.

In each case, the temperature resistance of the area at risk is improved, a situation which significantly widens the areas of application of the press roller. This is particularly true of press rollers having a flexible roller jacket which by means of a pressure-application unit are pressed against a preferably heated counter roller to produce a pressure nip. As a result of the presence of the fibrous web in the pressure nip between the press roller and the heated counter roller—and, in addition, possibly of other bands also led through the pressure nip—the roller jacket is protected against thermal overload at least in its central area. This is necessary because the types of polyurethane used for roller jackets must not be allowed to reach temperatures of more than 80-100° C. in the course of continuous operation.

However, the outer ends of the roller jacket are not covered by the fibrous web or a band and can, therefore, come into direct contact with the counter roller which is heated up to 350° C.

Consequently, to bring about a restriction of expenditure and, nevertheless, achieve an adequate degree of thermal protection it is advantageous if the outer cylindrical surface is enveloped by a temperature-stable protective layer and/or a cover but only in the area of at least one, preferably both outer end(s) of the roller jacket.

However, a comprehensive degree of thermal protection is obtained if the outer cylindrical surface is completely covered by a temperature-stable protective layer and/or a cover. This will protect the roller jacket even if the fibrous web is damaged.

The increased temperature resistance permits a much wider use of the press roller in the machine, particularly in terms of de-watering and/or smoothing the fibrous web.

In a situation where several press rollers in the machine have the identical design it is also possible to reduce the number of reserve rollers required.

In order to obtain the necessary degree of temperature resistance, the temperature-stable protective layer or the cover should be made of a material with a low thermal conductivity and, in particular, one taking the form of Teflon, glass-fiber fabric, Kapton, mineral fibers, a ceramic, a silicate, a quartz, a polymer, PEEK or the like or alternatively a material which reflects heat well such as, in particular, aluminum, or a combination thereof.

Depending upon the material forming the temperature-stable protective layer this can be coated and/or sprayed at least to a partial extent over the outer cylindrical surface.

The temperature-stable cover can be formed at least to a partial extent by a film and/or adjacent wrapped bands. In that respect the bands may be wound on such that they are separated from one another, abut or overlap one another with or without a slope.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 2:
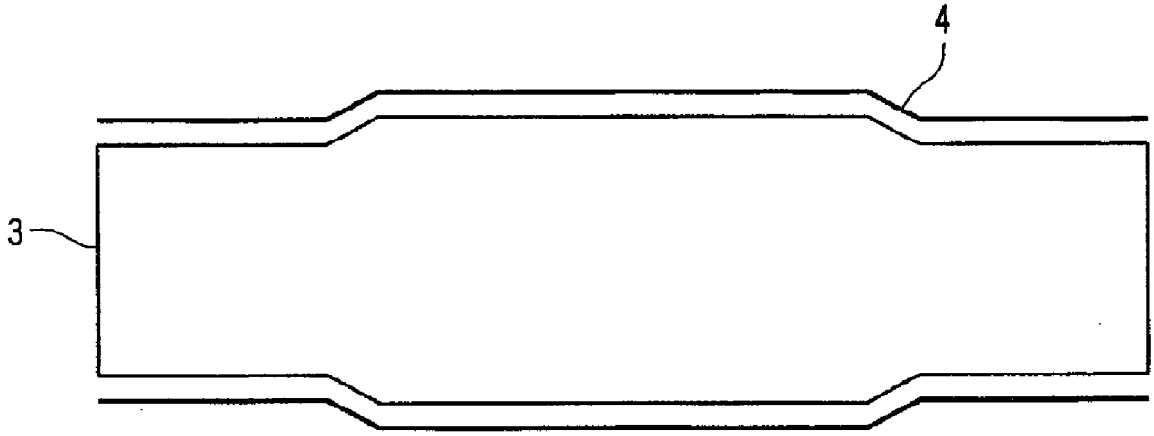
FIGS. 2 to 6 are different solutions for increasing the temperature stability of the roller jacket 3.

Corresponding reference characters indicate corresponding parts throughout the several views. The exemplification (s) set out herein illustrate(s) (one) embodiment(s) of the invention (, in one form,) and such exemplification(s) (is)(are) not to be construed as limiting the scope of the invention in any manner.

DETAILED DESCRIPTION OF THE INVENTION

Figure 1:
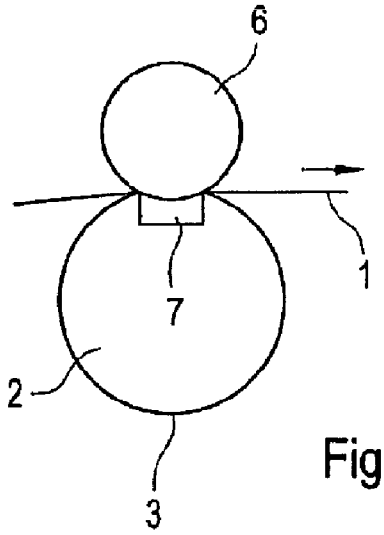
FIG. 1 is a schematic cross section through a press arrangement.

As shown in FIG. 1, the fibrous web 1 to be given smoothing treatment is led through an elongated pressure nip formed by a press roller 2 and a heated, cylindrical counter roller 6.

The press roller 2 possesses a flexible roller jacket 3 made of plastic which is pressed against the counter roller 6 by a pressure-application unit 7, which has a concave pressing surface.

The roller jacket 3 is made of polyurethane with a reinforcing thread-based fabric.

In order to avoid any damage to this roller jacket 3 by contact with the heated counter roller 6, the temperature-stability of the entire roller jacket 3 or at least the end areas of the roller jacket 3 lying beyond the fibrous web 1 can be increased by applying a protective layer 4 or a cover 5 to the outer cylindrical surface of the roller jacket 3.

To achieve a comprehensive level of thermal protection, the roller jacket 3 shown in FIG. 2 is completely covered outerly with a protective layer 4 made of glass fiber fabric.

Figure 3:
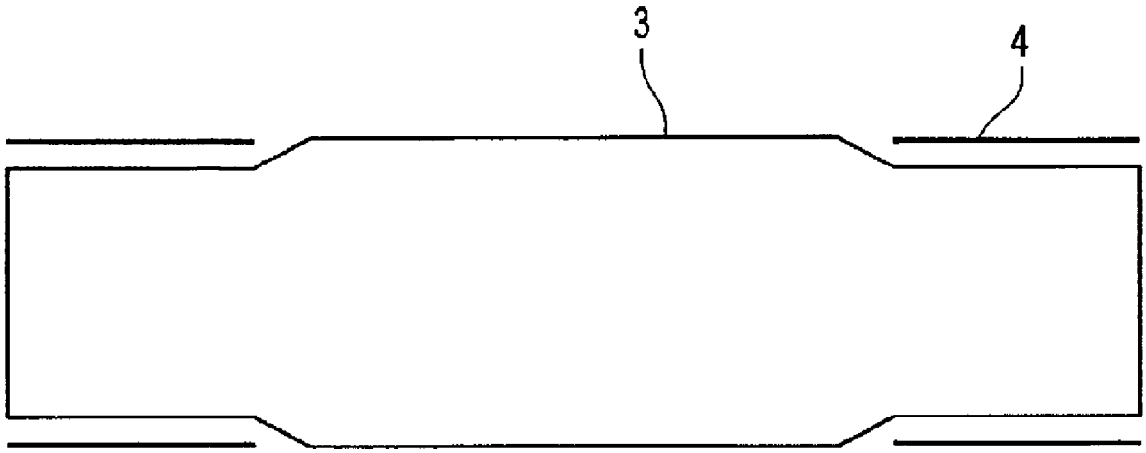

Contrary to this, only the end areas of the roller jacket 3 corresponding to FIG. 3 are covered by the protective layer 4.

Since these end areas lie at least partially outside the pressing surface of the pressure-application unit 7 these are also not so severely deformed as the central area of the roller jacket 3. This safeguards the protective layer 4 and widens the spectrum of the materials which can be used for the protective layer 4.

Figure 4:
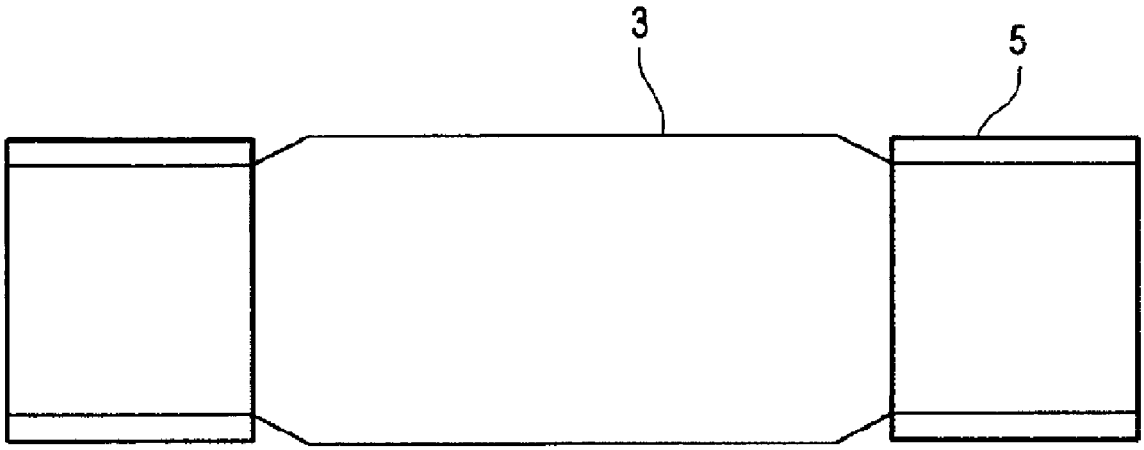
Figure 5:
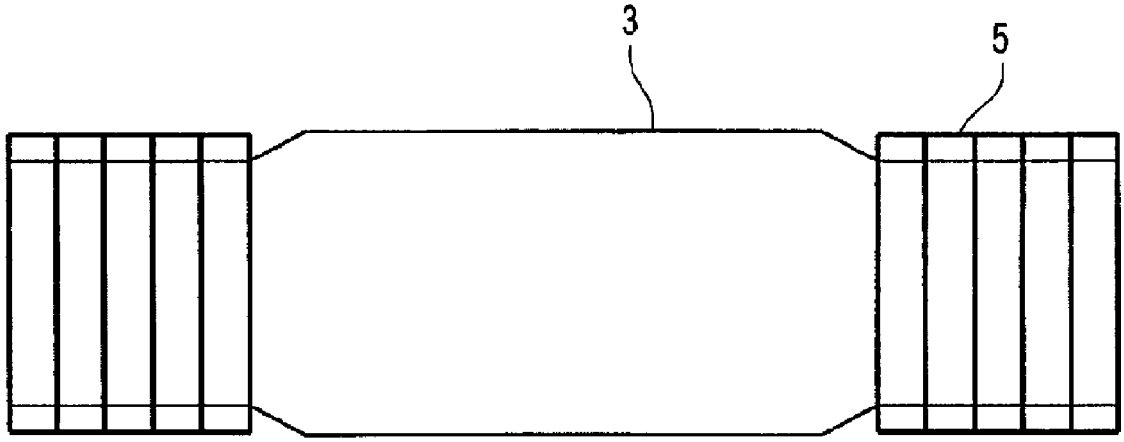
Figure 6:
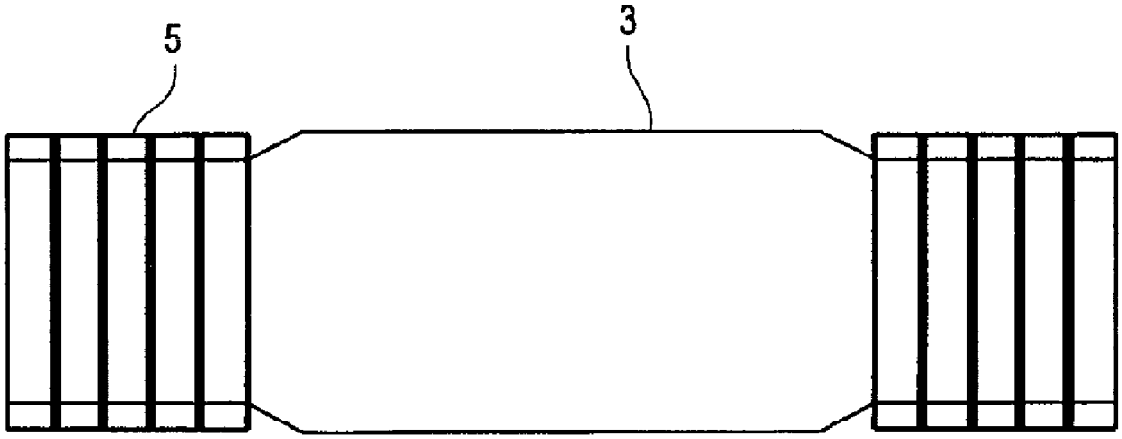

In the case of the roller jackets 3 illustrated in FIGS. 4 to 6, the thermal protection of the end areas of the roller jacket 3 is achieved by applying an appropriate temperature-stable cover 5.

This cover 5 is depicted in FIG. 4 in the form of a film. In FIGS. 5 and 6 the cover 4 consists of adjacent bands wound round the roller jacket 3. These bands can be wound as flush-surfaced bands as shown in FIG. 5 or as overlapping bands as shown in FIG. 6.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cylindrical press roller with a roller jacket having a midpoint and outer axial ends, said roller jacket made of plastic material for the treatment of a fibrous material web in a machine for the production and/or finishing thereof, said roller jacket having a given outer smooth pressure application cylindrical surface at the midpoint of said roller jacket, the outer diameter of said roller jacket at the axial outer ends being less than the outer diameter at the midpoint of said roller jacket, wherein the outer cylindrical surface of the roller jacket possesses at least partially at least one of a temperature-stable protective layer and a cover each having an axial length, wherein the outer cylindrical surface is enveloped by at least one of a temperature-stable protective layer and a cover only in the area of at least one of the outer axial ends of the roller jacket and wherein the outer diameter of said at least one of a temperature-stable protective layer and a cover is not substantially greater than the outer diameter of the cylindrical surface of the midpoint of said roller jacket and said one of a temperature-stable protective layer and a cover contacts the outer cylindrical surface the entire axial length of said one of a temperature-stable protective layer and a cover.

2. A press roller as claimed in claim 1, wherein at least one of the temperature-stable protective layer and the cover is made of at least a material with a low thermal conductivity selected from the group consisting of Teflon, glass-fiber fabric, Kapton, mineral fibers, a ceramic, a silicate, a quartz, a polymer, and PEEK, and a material which reflects heat well.

3. A press roller as claimed in claim 2, wherein said material that reflects heat is aluminum.

4. A press roller as claimed in claim 1, wherein the outer cylindrical surface is enveloped by at least one of a temperature stable protective layer and a cover only in the area of both outer ends of the roller jacket.

5. A press roller as claimed in claim 1, wherein the temperature-stable protective layer is coated at least to a partial extent over the outer cylindrical surface.

6. The press roller as claimed in claim 1, wherein the temperature-stable protective layer is sprayed at least to a partial extent over the outer cylindrical surface.

7. A press roller as claimed in claim 1, wherein the temperature-stable cover is formed at least partially by a film.

* * * * *